US011203459B2

(12) United States Patent
Topfer et al.

(10) Patent No.: US 11,203,459 B2
(45) Date of Patent: Dec. 21, 2021

(54) PACKAGING FOR EDIBLE PRODUCT

(71) Applicant: MARS, INCORPORATED, McLean, VA (US)

(72) Inventors: Kevin Topfer, Brighouse (GB); Daniel Reaney, Birmingham (GB); David Reed, Colton (GB)

(73) Assignee: MARS, INCORPORATED, McLean, VA (US)

( * ) Notice: Subject to any disclaimer, the term of this patent is extended or adjusted under 35 U.S.C. 154(b) by 0 days.

(21) Appl. No.: 16/608,098

(22) PCT Filed: Apr. 26, 2018

(86) PCT No.: PCT/GB2018/051107
§ 371 (c)(1),
(2) Date: Oct. 24, 2019

(87) PCT Pub. No.: WO2018/197886
PCT Pub. Date: Nov. 1, 2018

(65) Prior Publication Data

US 2020/0095014 A1 Mar. 26, 2020

(30) Foreign Application Priority Data

Apr. 28, 2017 (GB) ..... 1706850

(51) Int. Cl.
*B65D 5/32* (2006.01)
*B65D 5/54* (2006.01)
(Continued)

(52) U.S. Cl.
CPC ..... *B65D 5/322* (2013.01); *B65B 5/028* (2013.01); *B65B 25/005* (2013.01); *B65D 5/54* (2013.01); *B65D 85/60* (2013.01)

(58) Field of Classification Search
CPC ..... B65D 5/322; B65D 5/54; B65D 85/60; B65D 5/16; B65D 5/32; B65D 5/66; B65F 1/1607
(Continued)

(56) References Cited

U.S. PATENT DOCUMENTS 2,477,902 A * 8/1949 Scandore ..... B65D 5/5246 206/767
4,191,288 A * 3/1980 Hostad ..... B65D 5/5206 206/764
(Continued)

FOREIGN PATENT DOCUMENTS

CN 202728698 U 2/2013
CN 103879630 A 6/2014
(Continued)

*Primary Examiner* — Christopher R Demeree

(57) ABSTRACT

There is disclosed packaging for edible product comprising a base component and a separate lid component. The base component is formed from a folded blank and has an opening which provides access to a hollow interior for storing edible product. The lid component is bonded to the base component so as to close the opening and inhibit access to the interior. The lid component comprises an access panel which can be moved with respect to the base component to open the packaging and provide access to the interior through the opening. There is also disclosed a method for manufacturing a packaged product.

9 Claims, 8 Drawing Sheets

(51) Int. Cl.
*B65D 85/60* (2006.01)
*B65B 5/02* (2006.01)
*B65B 25/00* (2006.01)

(58) Field of Classification Search
USPC ..... 229/116.1, 241, 123.3, 125.14; 206/736, 206/766, 772, 45.23; 220/810
See application file for complete search history.

(56) References Cited

U.S. PATENT DOCUMENTS

| | | | | |
|---|---|---|---|---|
| 4,382,504 | A * | 5/1983 | Vesborg | B65D 5/5233 206/45.22 |
| 4,738,365 | A * | 4/1988 | Prater | B65D 5/302 229/123.3 |
| 4,819,839 | A | 4/1989 | Carlsson et al. | |
| 5,555,982 | A * | 9/1996 | Kuhn | B65D 5/323 206/526 |
| 5,657,872 | A * | 8/1997 | Leftwich | B65D 5/325 206/738 |
| 5,842,576 | A * | 12/1998 | Snow | B65D 5/5445 206/736 |
| D503,614 | S | 4/2005 | Sax et al. | |
| 8,439,187 | B2 * | 5/2013 | Tumminia | B65D 5/68 206/45.29 |
| 9,738,413 | B2 * | 8/2017 | Humphrey | B65D 5/5495 |
| 9,938,040 | B2 * | 4/2018 | Buscema | B31B 50/812 |
| 9,994,356 | B2 * | 6/2018 | Couture | B65D 5/5445 |
| 2003/0226783 | A1 * | 12/2003 | Jackson | B65D 5/16 206/772 |
| 2005/0263434 | A1 * | 12/2005 | Tibbels | B65D 5/0227 206/767 |
| 2012/0132562 | A1 | 5/2012 | Tumminia et al. | |

FOREIGN PATENT DOCUMENTS

| | | | |
|---|---|---|---|
| DE | 19635190 | A1 | 3/1998 |
| EP | 0663343 | A1 | 7/1995 |
| EP | 0922642 | A1 | 6/1999 |
| EP | 2174876 | B1 | 4/2010 |
| JP | S60179635 | U | 11/1985 |
| JP | 2002225854 | A | 8/2002 |
| JP | 2009269667 | A | 11/2009 |
| NZ | 522336 | A | 3/2004 |
| RU | 2376222 | C2 | 12/2009 |
| WO | 2008086582 | A1 | 7/2008 |

* cited by examiner

PACKAGING FOR EDIBLE PRODUCT

BACKGROUND OF THE DISCLOSURE

The invention relates to packaging for edible product such as confectionery, and a method of manufacturing a packaged product.

It is known to form packaging for edible products by folding a single blank, such as a cardboard blank. For example, in one previously considered arrangement a blank is folded and glued to create a partially formed box (or carton) having an open side. Product is then dispensed into the partially formed box through the open side, and the open side is then closed and glued to complete the box. Whilst such an arrangement may be entirely satisfactory, it may be a requirement that the box has a minimum height (or depth) in order to ensure that it can be easily and reliably filled with product. This may result in a box that is larger than required for the contents.

It may therefore be desirable to provide improved packaging which may address at least some of the above problems to at least some extent.

SUMMARY OF THE DISCLOSURE

According to an aspect there is provided packaging for edible product, comprising: a base component formed from a folded blank, wherein the base component has an opening which provides access to a hollow interior for storing edible product; a lid component bonded to the base component over the opening so as to close the opening and inhibit access to the interior, wherein the lid component comprises an access panel which can be moved with respect to the base component to open the packaging and provide access to the interior through the opening; wherein the base component and the lid component are separate components. The base component and lid component may be formed separately and subsequently assembled. Prior to bonding the lid component to the base component, the base component and lid component may be discrete. This construction may allow the hollow interior to be filled with edible product through the opening prior to the lid component being bonded to the base component. The base component may be formed from a single continuous substrate. The base component blank may be formed from a single continuous substrate. The base component may be formed by bonding, such as by gluing or adhering, parts of a blank.

The opening may be a filling opening and may also serve as an access opening. The opening may be a cut-out. The cut-out may be defined by a peripheral edge region.

The opening may be a cut-out in a material substrate. The opening may be smaller than the face in which it is formed or provided.

The lid component may comprise a fixed portion which is bonded to the base component. The access panel may be moveable with respect to the fixed portion so as to open the packaging. At least one weakened region may be provided between the fixed portion and the access panel so as to allow the access panel to be moved with respect to the fixed portion. The weakened region may comprise a perforation and/or a score line. The access panel and fixed portion may be contiguous. The access panel may be at least partly separable from the fixed portion. The access panel and fixed portion may be formed from a single continuous substrate. The fixed portion may surround the access panel.

The access panel may be pivotable with respect to the fixed portion so as to open the packaging. The lid component may comprise a cover which overlies the access panel and which is moveable so as to expose the access panel. The cover may be attached to the access panel. The cover may be detachable from the access panel so as to expose the access panel. The cover may be formed from two layers.

The lid component may be formed from a folded blank. The lid component blank may be formed from a single continuous substrate.

The base component may comprise a base face, at least one side face, and a top face, and wherein the opening is provided in the top face. The top face may be larger than the at least one side face. The base component may be substantially cuboidal. The faces of the base component may all be rectangular.

The fixed portion of the lid component may comprise first and second tabs that are bonded to first and second opposing side faces (or walls) of the base component. The lid component may straddle the base component. The lid component may comprise a top (or central) panel that overlies the opening and/or the top face (or wall) of the base component. The top (or central) panel may comprise a fixed portion and the access panel. The fixed portion of the top panel may be bonded to the base component. The first and second tabs may be substantially the same size as the respective sides to which they are bonded. The outer periphery of the first and second tabs may correspond (i.e. may be substantially the same) as the first and second sides to which they are bonded. The first and second tabs may therefore cover substantially all of the first and second sides respectively. The outer periphery of the top panel may substantially correspond (i.e. may be substantially the same) as the top face (or top wall) which it overlies. The top panel may therefore cover substantially all of the top face of the base component.

The base component and the lid component may be formed from substantially the same material. The base component and/or the lid component may be formed from cardboard. An outer surface of the base component and/or the lid component may be provided with a graphic design. The inner surface of the base component and/or the lid component may be provided with a protective layer.

According to another aspect there is provided a packaged product comprising packaging in accordance with any statement herein with edible product within the hollow interior of the base component. The edible product may be confectionery pieces or candy pieces or the like.

According to a further aspect there is provided a base component blank and a lid component blank for forming the packaging in accordance with any statement herein.

According to yet a further aspect there is provided a kit of parts (otherwise referred to as stock or inventory) comprising: a plurality of base component blanks; a first set of lid component blanks comprising a plurality of substantially identical lid component blanks of a first type; and a second set of lid component blanks comprising a plurality of substantially identical lid component blanks of a second type different from the first type; wherein a base component blank and a lid component blank from either set can be assembled to form packaging in accordance with any statement herein. The base component blank may be a partially assembled base component. The lid components of the first and second type may be interchangeable.

The lid component blanks of the first type and the second type may be substantially the same shape. The lid component blanks of the first type and the second type may be provided with a different graphic design. This may allow generic base component blanks to be manufactured and stored, and multiple different types of lid component blanks to be manufactured and stored. During manufacture different lid component blanks can be applied to the generic base blank depending on requirements. For example one lid component blank may be chosen during a particular season and a second lid component blank may be chosen for another different season.

According to a further aspect there is provided a method of manufacturing a packaged product, comprising: dispensing edible product into a hollow interior of a base component through a filling opening, the base component being formed from a folded blank; bonding a separate lid component to the base component so as to close the filling opening, wherein the lid component comprises an access panel which can be moved with respect to the base component to open the packaging and provide access to the interior through the filling opening. It should be appreciated that the order in which the method steps are presented are not limiting and they may be performed in any suitable order.

The opening may be a cut-out. The lid component may comprise a fixed portion. The access panel may be moveable with respect to the fixed portion so as to open the packaging. The method may further comprise bonding the fixed portion to the base component.

The method may further comprise forming the base component by folding a blank. The method may further comprise forming the lid component by folding a blank.

The base component may comprise a base face, at least one side face, and a top face. The opening may be provided in the top face. The base component may be substantially cuboidal. The fixed portion of the lid component may comprise first and second tabs. The method may comprise bonding the first and second tabs to first and second opposing side faces of the base component. The first and second tabs may be substantially the same size as the respective sides to which they are bonded.

The method may further comprise selecting a lid component blank from at least: a first set of lid component blanks comprising a plurality of substantially identical lid component blanks of a first type; and a second set of lid component blanks comprising a plurality of substantially identical lid component blanks of a second type different from the first type. There may be more than two sets of lid component blanks.

The lid component blanks of the first type and the second type may be substantially the same shape. The lid component blanks of the first type and the second type may be provided with a different graphic design.

The method may further comprise applying a personalized graphic design to the lid component. The personalized graphic design may be designed or chosen by the end consumer. The personalized graphic design may be designed at a terminal (e.g. a computer, tablet, smart phone) that is remote from the manufacturing site. The method may further comprise receiving digital printing instructions relating to a graphic design to be applied to the lid component, and utilizing the digital printing instructions to apply a graphic design to the lid component. The digital printing instructions may be generated by an end consumer using a design tool provided at a terminal remote from the manufacturing site of facility.

According to yet a further aspect there is provided packaging comprising: a substantially cuboidal base component comprising a base wall, first and second opposing side walls, third and fourth opposing side walls, and a top wall, wherein the base component is formed from a folded blank and defines a hollow interior, and wherein a cut-out opening is provided in the top wall; and a separate lid component comprising a top panel which overlies the top wall of the base component so as to close the opening and first and second tabs which are bonded to the first and second side walls respectively, wherein the top panel comprises an access panel which can be moved with respect to the remainder of the top panel to open the packaging and provide access to the interior through the opening. The outer periphery of the top panel may correspond to the outer periphery of the top wall. The outer periphery of the first and second tabs may correspond to the outer periphery of the first and second side walls respectively.

The invention may comprise any combination of the features and/or limitations referred to herein, except combinations of such features as are mutually exclusive.

BRIEF DESCRIPTION OF THE DRAWINGS

Embodiments of the invention will now be described, by way of example, with reference to the accompanying drawings, in which.

DETAILED DESCRIPTION OF THE DISCLOSURE

Figure 1:
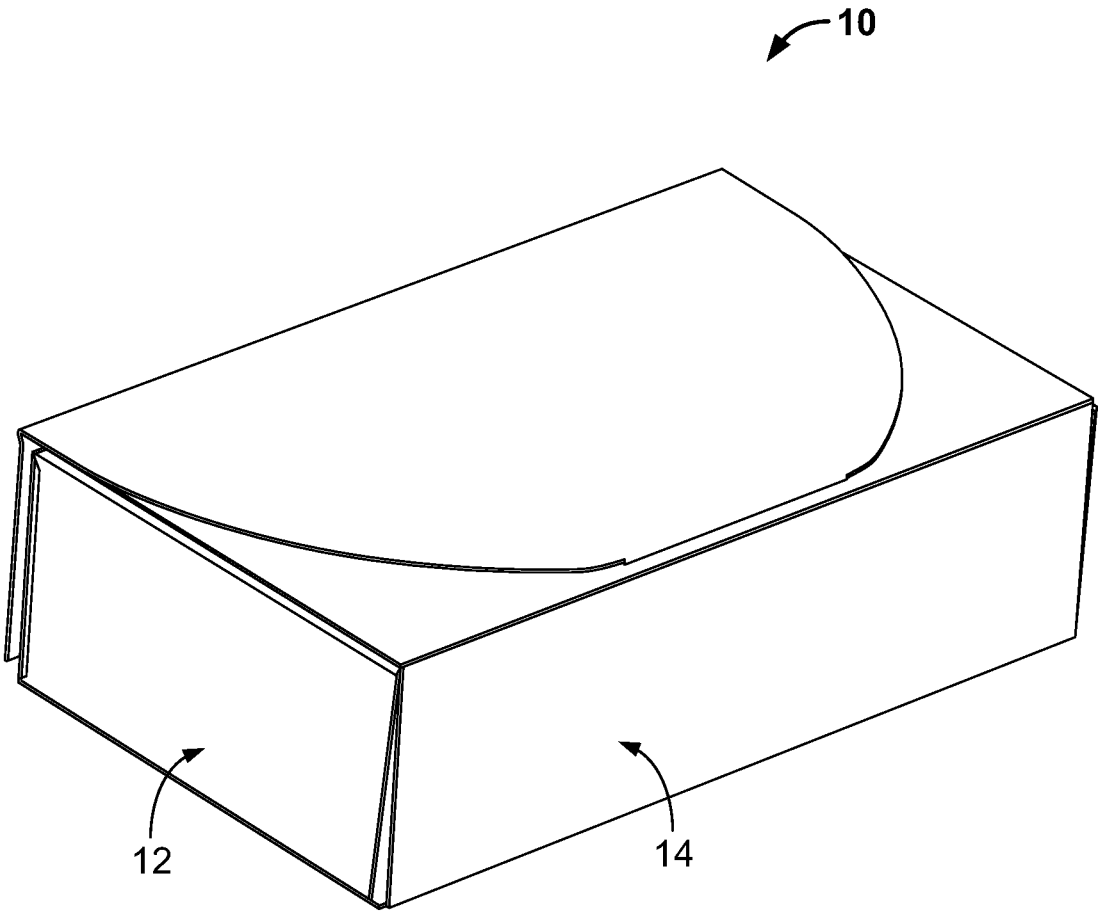
FIG. 1 schematically shows a perspective view of a packaged product in the form of a carton containing edible product with a cover in a closed position.

FIG. 1 shows packaging in the form of a carton 10 (or box) which contains edible product, such as pieces of confectionery or candy. The carton 10 is constructed such that it holds its shape (i.e. it is semi-rigid). In this arrangement the carton 10 is substantially cuboidal and comprises a cuboidal base component 12 and a separate lid component 14. As will be described in detail below, the base component 12 and the lid component 14 are formed from separate blanks.

Figure 2:
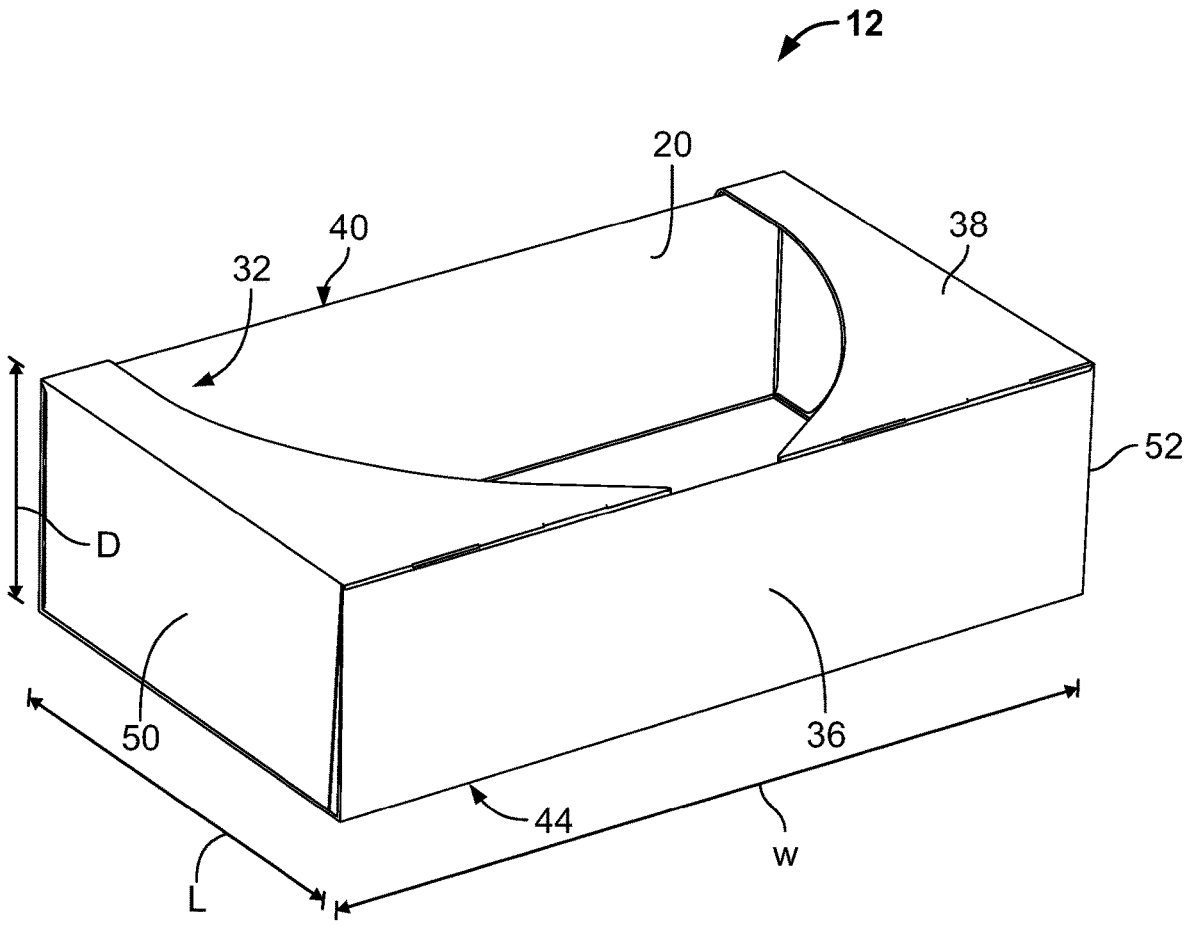
FIG. 2 schematically shows a perspective view of a base component of the carton of FIG. 1.

Referring to FIG. 2, the base component 12 is substantially cuboidal and is approximately the same size as the carton. The base component 12 defines a hollow interior 32 which provides a storage compartment for the product to be packaged. The base component 12 generally comprises a base wall (or face) 44, a front wall (or face) 36, a rear wall (or face) 40, a top wall (or face) 38, a left side wall (or face) 50 and a right side wall (or face) 52. In this arrangement the width W of the carton 10 (and therefore the base component 12) is greater than the length L, which in turn is greater than the depth D. Thus, the base wall 44 and the top wall 38 form the major faces of the packaging (i.e. they are the faces having the largest area). An opening 20, in the form of a cut-out, is formed in the top wall 38. The opening 20 is substantially semi-circular and takes up the majority of the upper wall 38. As will be described below, the opening 20 is both a filling opening through which edible product is dispensed during manufacture, and an access opening through which product can be removed by the consumer.

Figure 3:
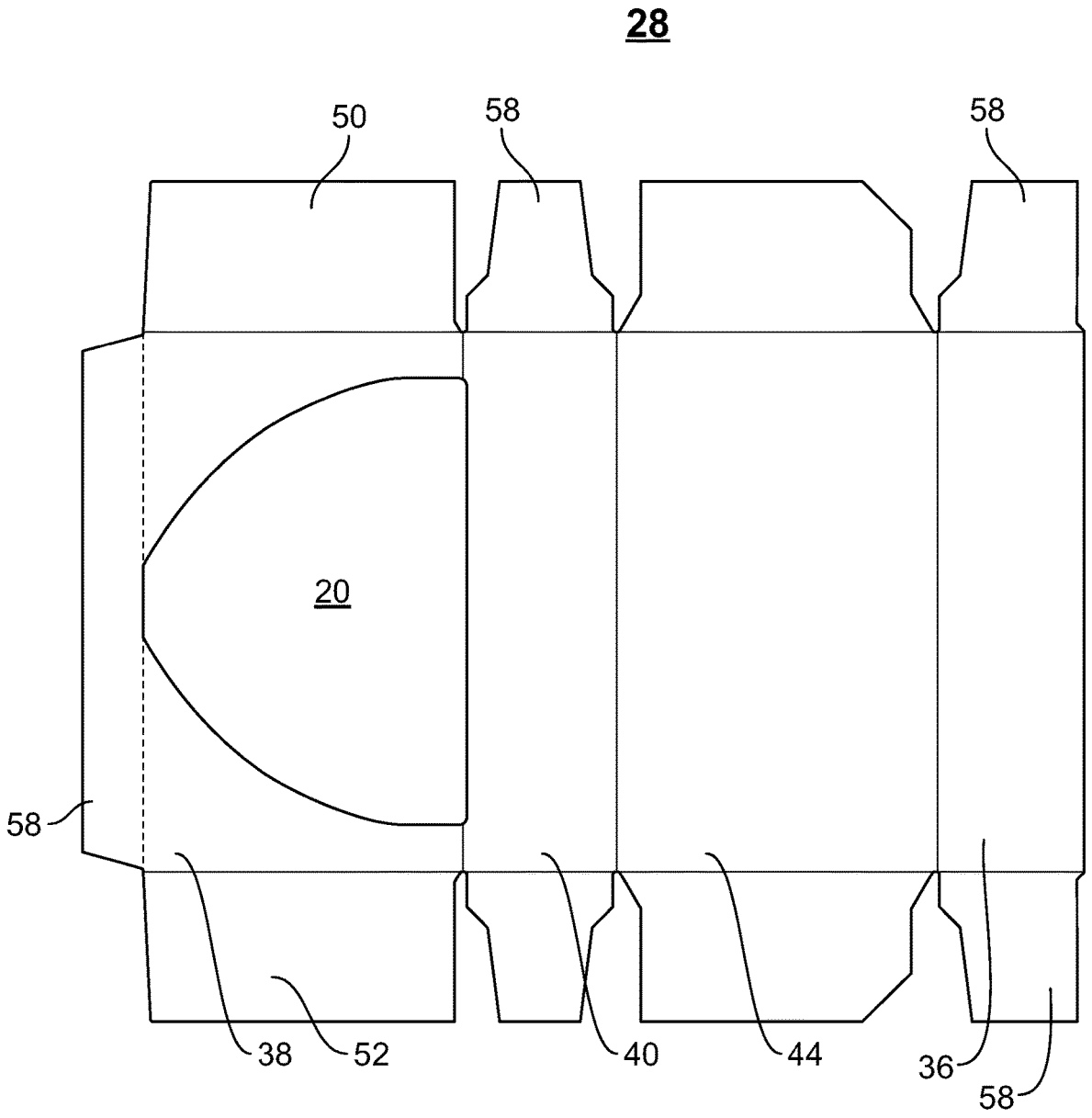
FIG. 3 schematically shows a blank for forming the base component of FIG. 2.

Referring to FIG. 3, the base component 12 is formed from a base component blank 28. In this arrangement the base component blank 28 is formed from a single continuous cardboard substrate. An outer surface of the blank 28 is provided with a graphical design, and an inner surface of the blank 28 is provided with a PE food-safe coating or layer. The blank 28 defines the walls 38, 40, 44, 36, 50, 52 and the opening 20, in the form of a cut-out, is provided in the blank 28. The blank also comprises various securing tabs 58. In order to assemble the base component 16 the blank 28 is folded and the tabs 58 are glued to hold the base compartment together.

Figure 4:
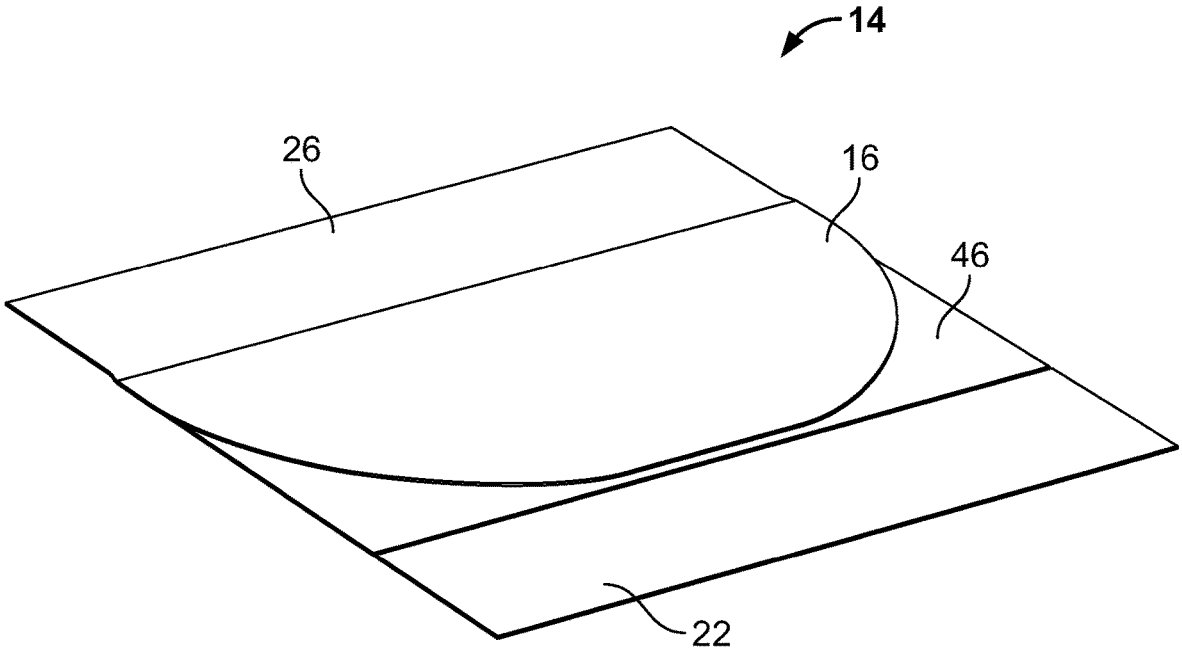
FIG. 4 schematically shows a perspective view of a lid component of the carton of FIG. 1 with the cover in a closed position.
Figure 5:
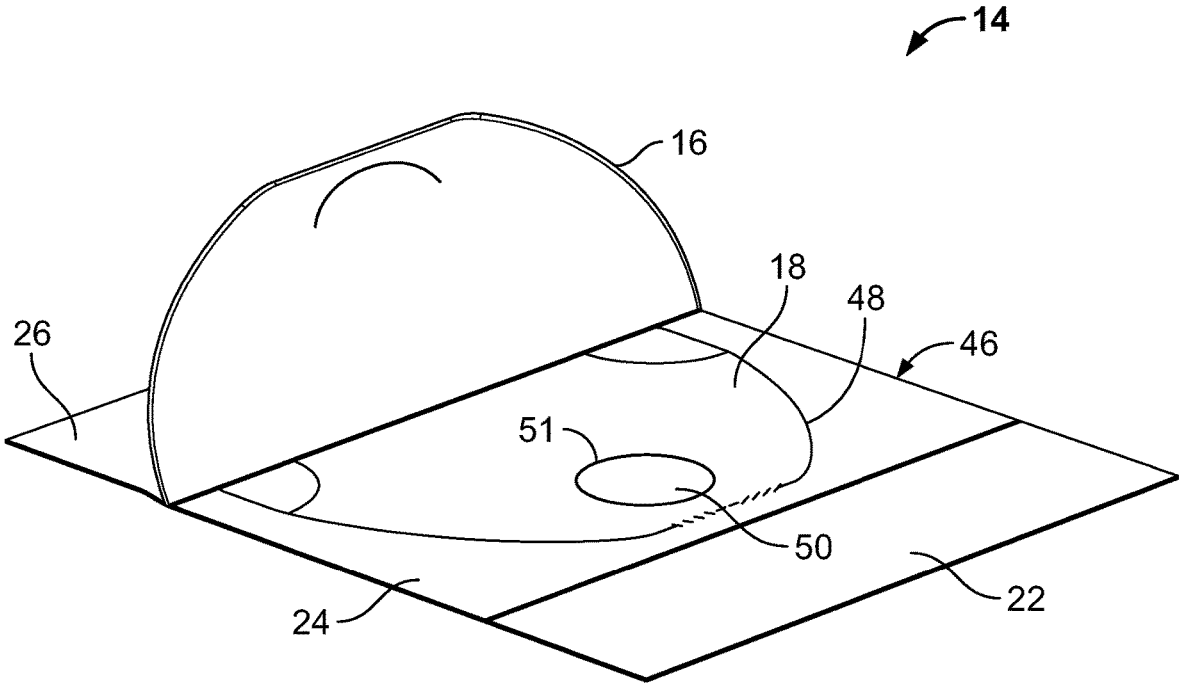
FIG. 5 schematically shows the lid component of FIG. 4 with the cover in an open position.

Referring to FIGS. 4 and 5, the lid component 14 is arranged to sit over the base component 12 so as to cover the opening 20 and is arranged to be bonded to the base component 28. The lid component 14 comprises four adjacent portions, which are separated by transverse parallel folds, namely: a front tab 22, a top panel 46, a semi-circular cover 16 and a rear tab 26. The front and rear tabs 22, 26 are rectangular and are of substantially the same size as the front and rear walls 36, 40 of the base component 12 (and are substantially the same side as each other). The top panel 46 is rectangular and is substantially the same size as the top wall 38 of the base component 12. The cover 16 is formed from a double layer of folded substrate. The fold between the cover 16 and the rear tab 26 acts as a hinge such that the cover 16 can move (or pivot) between a closed position (FIG. 4) in which it lies against the top panel 46 and an open position (FIG. 5).

As best shown in FIG. 5, the top panel 46 comprises a central semi-circular access panel 18 and an outer region 24. The access panel 18 and the outer region 24 are contiguous with one another and a weakening, in the form of a perforated semi-circle 48, is arranged between them. The outer region 24 is arranged to be bonded to the top wall 38 of the base component 12 such that top panel 46 covers the top wall 38. The access panel 18 is slightly smaller than the opening 20 and is arranged to sit over it. In use, the access panel 18 can be pulled away from the remainder of the top panel 46 (i.e. the outer region 24) causing the perforations to tear. As will be described, this allows the access panel 18 to be pivotally moved to an open position.

When the lid component 14 is in the assembled state shown in FIG. 4, the underside of the cover 16 is glued to a disc 50 which is defined in the access panel 18 by a circular weakening region in the form of perforations 51. The perforations 51 are weaker than the perforations 42 such that when the cover 16 is moved from the closed position (FIG. 4) to the open position (FIG. 5) the disc 50 pulls away from access panel 18, thereby providing a lift hole.

Figure 6:
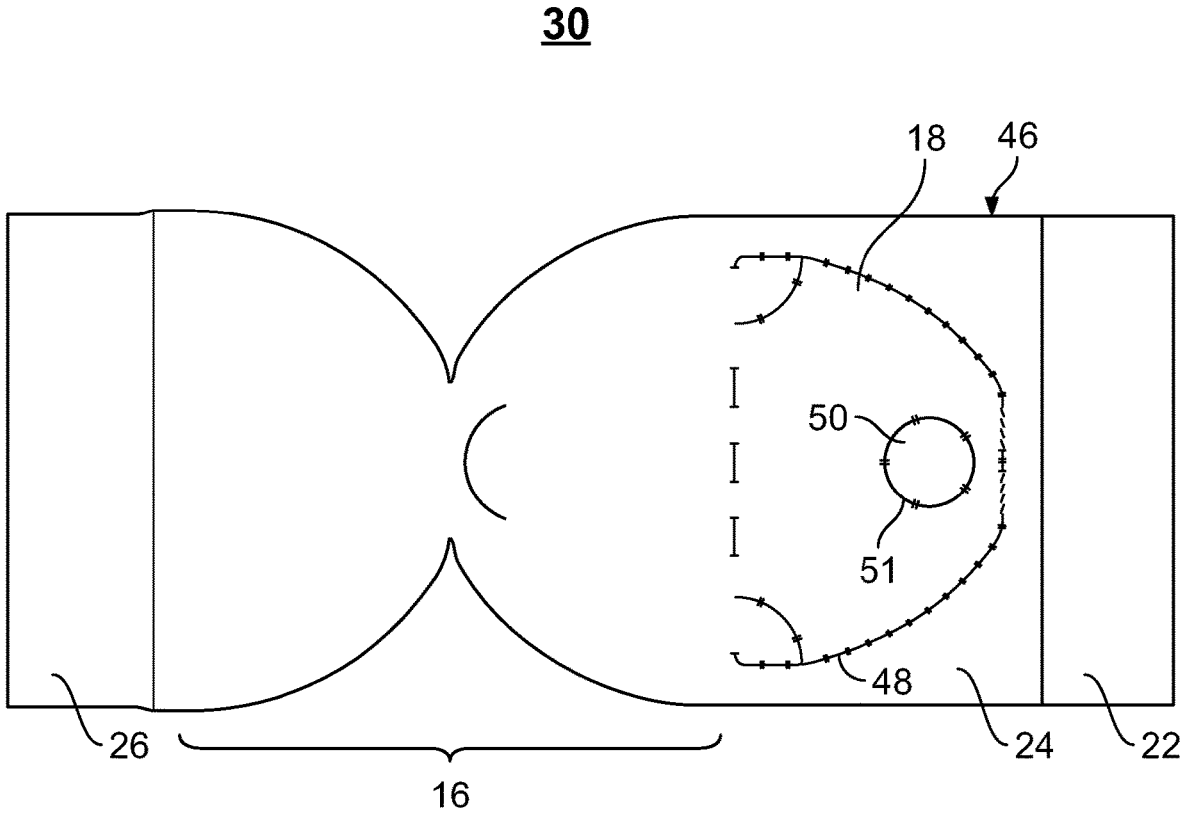
FIG. 6 schematically shows a blank for forming the lid component of FIG. 5.

Referring to FIG. 6, the lid component 14 is formed from a lid component blank 30 that is distinct and separate from the base component blank 28. In this arrangement the lid component blank 30 is formed from a single continuous cardboard substrate. An outer surface of the blank 30 is provided with a graphical design, and an inner surface of the blank 30 is provided with a PE food-safe coating or layer. The blank 28 defines the tabs 22, 26, the top panel 46 and the double-layer cover 16. In order to assemble the lid component 14, the blank 30 is folded, the cover 16 is formed by gluing the two layers together, and the inner surface of the cover 16 is glued to the disc 50.

The base component 12 and the lid component 14 are assembled together to form the carton 10. The base component 12 may be assembled by a folding machine folding a base component blank 28, and similarly the lid component 14 may be assembled by a folding machine folding a lid component blank 30. Prior to assembling the two components 12, 14 together, edible product, such as confectionery or candy, is dispensed into the hollow interior 32 of the base component 12 through the filling/access opening 20 provided in the top wall 38. The hollow interior 32 may be filled with product using an automatic filling or dispensing machine or the like. Once the hollow interior 32 has been filled with product, the assembled lid component 14 is placed over the opening 20 such that the top panel 46 completely covers the top wall 38 and closes the opening 20. In order to secure the lid component 14 to the base component 12 the front and rear tabs 22, 26 are bonded to the front and rear side walls 36, 40 (such as by gluing) such that they completely cover the respective walls, and the top panel 46 is bonded to the top wall 38 (such as by gluing) such that it completely covers the top wall 38. This closes the opening 20 and prevents product from leaving through the opening 20. The assembled and filled carton 10 may be wrapped with a filmic overwrap to maintain product freshness. It will be appreciated that all folding, assembly, bonding, filling and/or wrapping may be accomplished using appropriate machinery.

Figure 7:
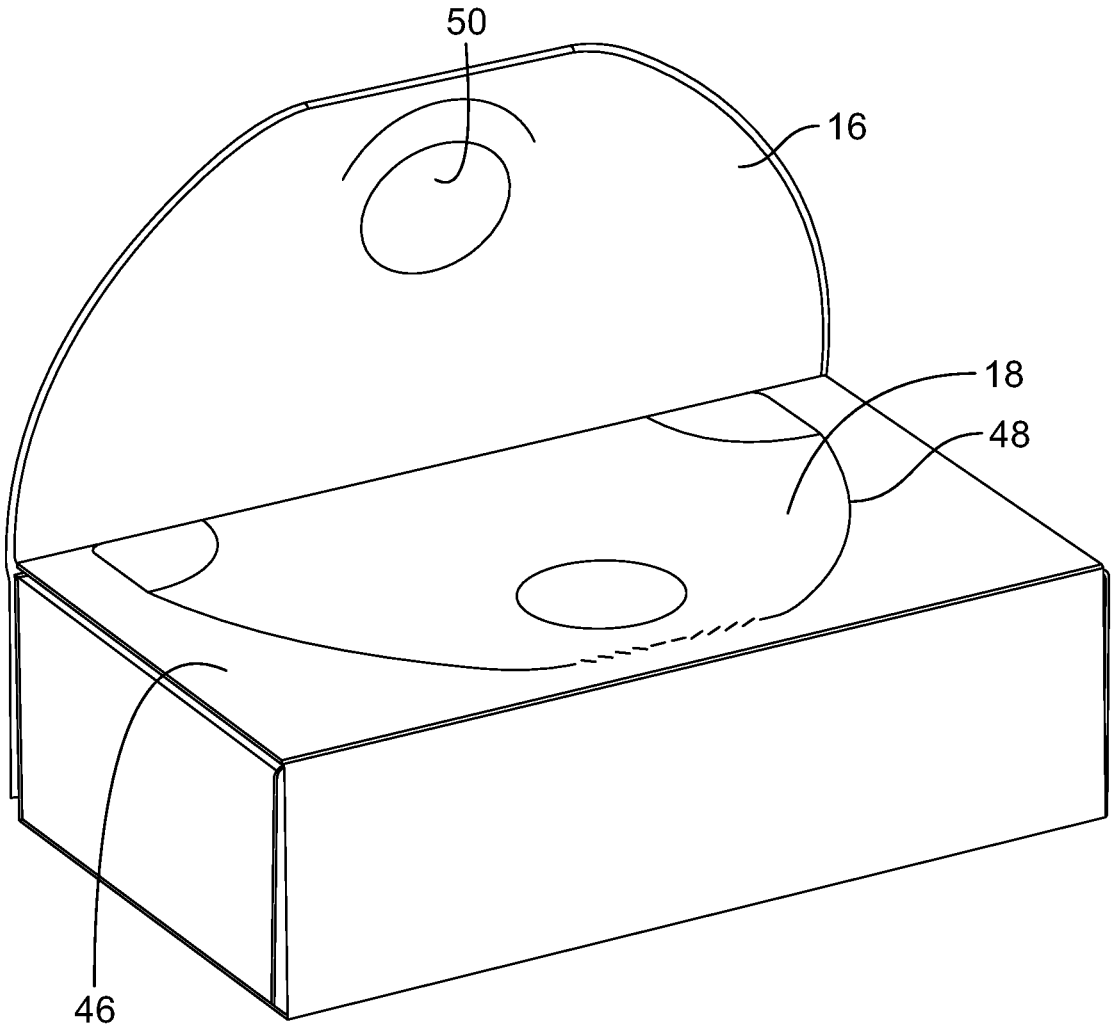
FIG. 7 schematically shows the carton of FIG. 1 with the cover in an open position.
Figure 8:
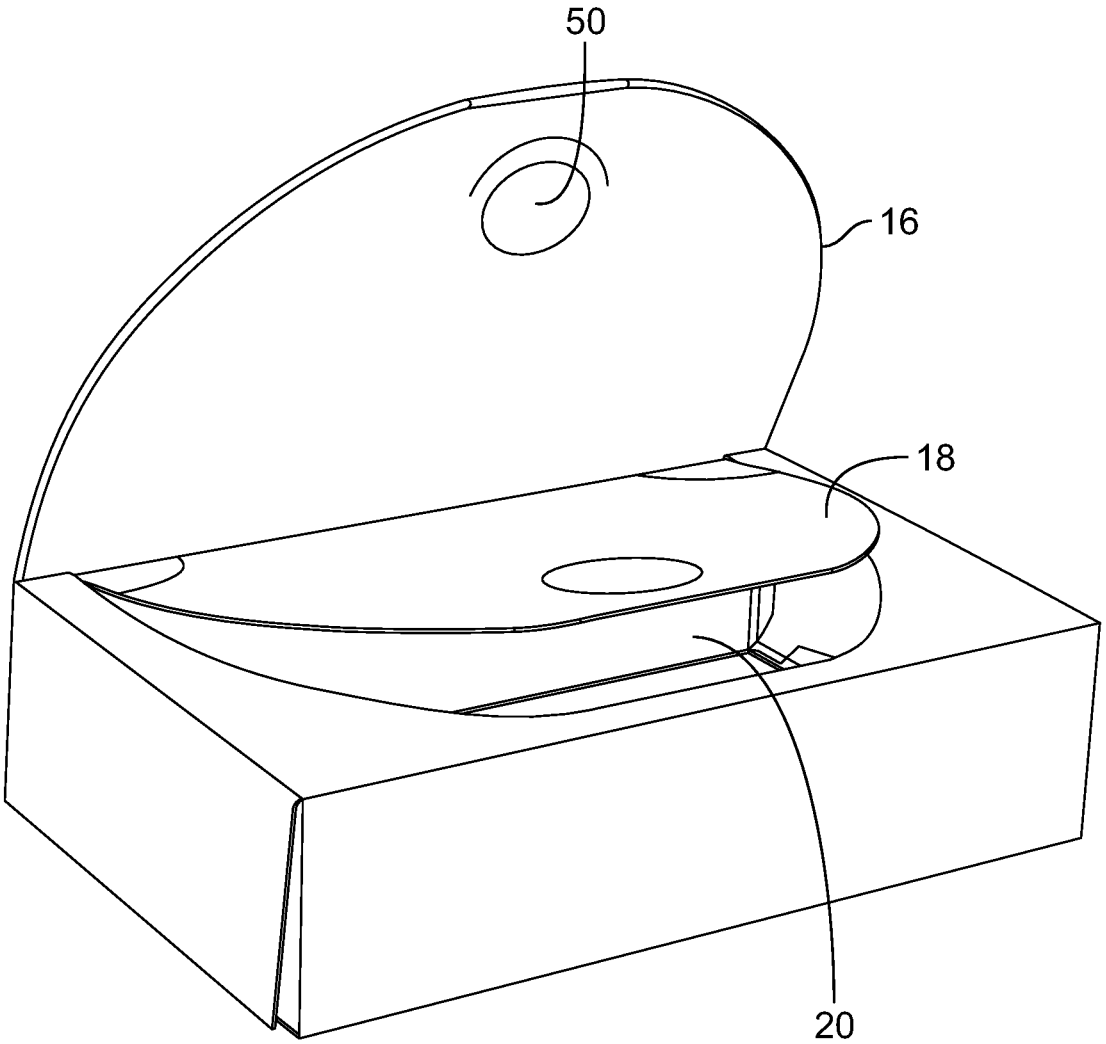
FIG. 8 schematically shows the carton of FIG. 1 with the cover in an open position and with an access panel removed.

In order to open the carton 10 the cover 16 is moved to an open position (FIG. 7) by pulling it upwards away from the main body of the carton 10. This causes the perforations 51 to break and the disc 50 to be separated from the access panel 18, allowing the cover 16 to pivot to an open position in which the access panel 18 is exposed. The access panel 18 can then itself be moved to an open position (FIG. 8) by pulling it upwards away from the main body of the carton 10. This causes the perforations 48 to break, allowing the access panel to pivot to an open position. In the open position the filling opening 20 is exposed such that product within the hollow interior 32 can be accessed through the opening 20. In another arrangement, the access panel may be removed entirely from the remainder of the top panel 46 (e.g. by separating along perforated lines).

The construction of the packaging may provide a number of advantages over previously considered arrangements.

Using two separate blanks 28, 30, one for the base compartment 12 and one for the lid component 14, allows the packaging 10 to be customised with ease with minimal expense. For example, a generic base component blank 28 may be produced, and a number of different sets of lid component blank 30 may also be produced. The generic base component blank 28 could be used for all cartons 10, but a particular lid component blank 30 may be selected and bonded to the generic base component 28 depending on particular requirements. For example, there could be different lid component blanks 30 for different seasons, festivals, holidays, or events. However, all lid component blanks 30 may have substantially the same shape and structure.

In another arrangement it may be possible for an end-consumer to generate and apply a personalized graphic to the packaging 10. For example, it may be possible for the consumer to generate a design for the lid component 14 using a terminal provided in-store, for example, or at a remote terminal (e.g. a personal computer, tablet, smart phone or the like). The design may generate digital print instructions which may be used to apply a personalized graphic onto the lid component blank 30 (or the lid component 14) which may then be bonded to the base component 12. This may allow a consumer to apply a personalized design, such as their name or a picture, to a carton with ease.

A further advantage may be realised in that the product is dispensed into the interior 32 of the base component 12 through a relatively large filling/access opening which is provided in a major face (e.g. the top face) of the base component 12. This may allow other dimensions, such as the height H, of the packaging 10 to be reduced. This may reduce manufacturing costs, shipping costs, or storage costs/space, for example.

Although it has been described that the lid component is formed from a folded blank and comprises an access panel and a cover, in other arrangements an access panel could be directly bonded to the base compartment over the opening. This would close the opening and the access panel could be bonded in such a way that it can be moved to a position in which the access opening is exposed. In other arrangements, the lid could comprise a fixed portion and an access panel, and the fixed portion could be bonded to the base component so that the access panel covers the opening. The access panel could be completely separated from the fixed portion by separating along perforations or weakened lines. It will be appreciated that other suitable lid component constructions could be used.

Further, it is not essential that the packaging is cuboidal. The packaging (i.e. the carton/box) could be any suitable shape such as cylindrical, or it could have a hexagonal or octagonal cross section.

What is claimed is:

1. Packaging for edible product, comprising:

a base component formed from a folded blank, wherein the base component has an opening which provides access to a hollow interior for storing edible product;

a lid component bonded to the base component over the opening so as to close the opening and inhibit access to the interior, wherein the lid component comprises an access panel which can be moved to an access panel open position with respect to the base component to open the packaging and provide access to the interior through the opening;

wherein the base component and the lid component are separate components;

wherein the lid component comprises a cover that is moveable from a closed position where the cover overlies and fully covers the access panel to an open position that exposes the access panel such that the access panel can then be moved to the access panel open position.

2. Packaging according to claim 1, wherein the opening is a cut-out.

3. Packaging according to claim 1, wherein the lid component comprises a fixed portion which is bonded to the base component, and wherein the access panel can be moved with respect to the fixed portion so as to open the packaging.

4. Packaging according to claim 3, wherein at least one weakened region is provided between the fixed portion and the access panel so as to allow the access panel to be moved with respect to the fixed portion.

5. Packaging according to claim 1, wherein the lid component is formed from a folded blank.

6. Packaging according to claim 1, wherein the base component comprises a base face, at least one side face, and a top face, and wherein the opening is provided in the top face.

7. Packaging according to claim 6, wherein the top face is larger than the at least one side face.

8. Packaging according to claim 1, wherein the base component is substantially cuboidal.

9. Packaging according to claim 8, wherein the lid component comprises a fixed portion which is bonded to the base component and wherein the fixed portion of the lid component comprises first and second tabs that are bonded to first and second opposing side faces of the base component.

* * * * *